US007975608B2

(12) United States Patent
Beck et al.

(10) Patent No.: US 7,975,608 B2
(45) Date of Patent: Jul. 12, 2011

(54) DEVICE AND A METHOD FOR FEEDING A MATERIAL WEB TO A PRINTING UNIT OF A WEB-FED ROTARY PRINTING PRESS

(75) Inventors: Peter Franz Beck, Karlstadt (DE); Erwin Paul Josef Lehrieder, Gaukönigshofen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 333 days.

(21) Appl. No.: 12/225,300

(22) PCT Filed: Mar. 23, 2007

(86) PCT No.: PCT/EP2007/052794

§ 371 (c)(1),
(2), (4) Date: Oct. 17, 2008

(87) PCT Pub. No.: WO2007/110386

PCT Pub. Date: Oct. 4, 2007

(65) Prior Publication Data

US 2010/0224088 A1 Sep. 9, 2010

(30) Foreign Application Priority Data

Mar. 27, 2006 (DE) ..... 10 2006 013 955

(51) Int. Cl.
*B41F 13/54* (2006.01)

(52) U.S. Cl. ..... 101/228; 101/220

(58) Field of Classification Search ..... 101/228
See application file for complete search history.

(56) References Cited

U.S. PATENT DOCUMENTS

| | | | | |
|---|---|---|---|---|
| 1,900,535 | A | 3/1933 | Wood | |
| 2,126,877 | A | 8/1938 | Foster | |
| 3,744,693 | A | 7/1973 | Greiner | |
| 5,228,672 | A | 7/1993 | Pane | |
| 5,400,940 | A | 3/1995 | Sato et al. | |
| 5,413,039 | A | 5/1995 | Sohma | |
| 5,423,468 | A * | 6/1995 | Liedtke | 242/615.12 |
| 5,464,143 | A * | 11/1995 | Hansen | 242/615.12 |
| 5,467,179 | A * | 11/1995 | Boeck et al. | 399/384 |
| 6,302,353 | B1 * | 10/2001 | Motegi et al. | 242/615.12 |

(Continued)

FOREIGN PATENT DOCUMENTS

DE 2 026 355 5/1970

(Continued)

*Primary Examiner* — Anthony H. Nguyen
(74) *Attorney, Agent, or Firm* — Jones, Tullar & Cooper, P.C.

(57) ABSTRACT

A device is usable for feeding a material web to a press unit of a web-fed rotary press having a reel carrier which carries a material reel and which is mounted next to the machine line. At least one deflection rod is arranged in the web transport path between the reel carrier and the press unit. The deflection rod is angled at 45° with respect to the transport direction of the web which wraps onto it. In at least a wraparound angular region of the material web, the deflection rod has outlet openings which are configured as micro-openings for the passage of a pressurized fluid. The mean diameter of these micro openings is, at most 500 μm. When the material web is moving about the deflection rod, the micro openings are provided with pressurized fluid on a length which is greater than the width of the region which is covered by the material web which wraps around it.

31 Claims, 14 Drawing Sheets

U.S. PATENT DOCUMENTS

| | | | | |
|---|---|---|---|---|
| 6,364,247 | B1 * | 4/2002 | Polkinghorne | 242/615.11 |
| 6,418,851 | B1 * | 7/2002 | Hartmann et al. | 101/485 |
| 6,695,250 | B2 * | 2/2004 | Michalik et al. | 242/615.21 |
| 6,705,220 | B2 * | 3/2004 | Boucher | 101/228 |
| 6,789,476 | B2 * | 9/2004 | Langsch | 101/228 |
| 6,796,524 | B2 * | 9/2004 | Pollock et al. | 242/615.12 |
| 6,832,549 | B2 | 12/2004 | Satoh | |
| 7,314,440 | B2 | 1/2008 | Boppel et al. | |
| 7,383,772 | B2 | 6/2008 | Boppel et al. | |
| 2001/0025577 | A1 * | 10/2001 | Cousin et al. | 101/228 |
| 2002/0124704 | A1 | 9/2002 | Roth | |
| 2003/0167943 | A1 | 9/2003 | Izawa et al. | |
| 2004/0134321 | A1 * | 7/2004 | Weis | 83/99 |
| 2004/0164477 | A1 * | 8/2004 | Buri et al. | 271/8.1 |

FOREIGN PATENT DOCUMENTS

| | | | |
|---|---|---|---|
| DE | 44 09 693 | C1 | 3/1994 |
| DE | 198 58 602 | A1 | 6/2000 |
| DE | 103 48 611 | B3 | 10/2003 |
| DE | 10 2004 018 401 | | 11/2005 |
| EP | 0 449 287 | A1 | 3/1991 |
| EP | 1 468 826 | A1 | 10/2004 |
| EP | 1 614 647 | A1 | 1/2006 |
| WO | WO 2004/037696 | A2 | 5/2004 |
| WO | WO 2005/105447 | A1 | 11/2005 |

* cited by examiner b)

a)

DEVICE AND A METHOD FOR FEEDING A MATERIAL WEB TO A PRINTING UNIT OF A WEB-FED ROTARY PRINTING PRESS

CROSS-REFERENCE TO RELATED APPLICATIONS

This application is the U.S. national phase, under 35 USC 371 of PCT/EP2007/052794, filed Mar. 23, 2007; published as WO 2007/110386 A2 and A3 on Oct. 4, 2007, and claiming priority to DE 10 2006 013 955.0, filed Mar. 27, 2006, the disclosures of which are expressly incorporated herein by reference.

FIELD OF THE INVENTION

The present invention is directed to a device and to a method for feeding a material web to a printing unit of a web-fed rotary printing press. The printing press is provided with a reel stand that carries a material reel. The reel stand is arranged laterally next to the printing press alignment. At least one turning bar is arranged in a web path between the reel stand and the printing unit. That at least one turning bar is angled at 45° in relation to the direction of transport of the material web running up to it.

BACKGROUND OF THE INVENTION

A device for feeding a material web to a printing couple is known from EP 1 468 826 A1. A plurality of printing units are arranged side by side in a machine alignment, viewed in the longitudinal direction of their printing couple cylinders. Reel changers are arranged next to this machine alignment, and are oriented with their rotational axes parallel to the printing couple cylinders. The web is turned, in its direction of transport, into the plane of the machine alignment via a turner bar, which is arranged above the printing unit, once the web has passed through the printing unit.

WO 2005/105447 A1 describes a device for feeding in a material web. A plurality of printing units are arranged side by side in a machine alignment, viewed perpendicular to the rotational axes of the printing couple cylinders. In one embodiment, reel changers are arranged next to this machine alignment and are oriented with their rotational axes perpendicular to the rotational axes of the printing couple cylinders. The direction of transport of the web is turned into the plane of the machine alignment, before the web enters the printing unit. This web turning is accomplished by using a turner bar, which is arranged inclined 45° in relation to the direction of transport of the incoming web and lying in a horizontal plane. In other embodiments, the reel changers are arranged aligned with the printing units in the same machine alignment, with their rotational axes parallel to the printing couple cylinders. These reel changers are situated either in a machine plane below the printing units, or are situated in the same machine plane.

A turner bar assembly is described in DE 198 58 602 A1 and is situated in a web path between printing couples, which are located upstream, in a direction of web travel, and a fold former, which is located downstream. The turner bars are arranged vertically to allow better accessibility.

Turner bars in the superstructure of a printing press are described in WO 2004/037696 A2. Air outlet openings are embodied as micro openings having diameters of, at most 500 μm, and especially at most 300 μm. The micro openings are open pores in a porous material or are openings of microscopic holes. In one embodiment, the micro openings extend around the entire 360° circumference of the turner bars and are supplied with air on both the web wraparound side and the non-wraparound side of the periphery of the turner bars.

DE 44 09 693 C1 describes a take-up device in a web path, downstream from the printing unit in the area of a turner bar assembly, and with which cut web sections are deflected laterally.

SUMMARY OF THE INVENTION

The object of the invention is to provide a device and a method for feeding a material web to a printing unit of a web-fed rotary printing press.

The object is attained according to the invention through the provision of a web-fed rotary printing press with a reel stand that carries a material reel. The reel stand is arranged laterally next to the machine alignment. At least one turner bar is arranged in the web path between the reel stand and the printing unit. The turner bar is inclined at 45° in relation to the direction of transport of the material web. The turner bar has outlet openings which are embodied as micro openings for the passage of a pressurized fluid. These outlet openings are located at least in an angular wraparound region of the material web. A maximum average diameter of these openings is 500 μm. The turner bar is supplied with air for passage through the micro openings over a length that is greater than the width of the area covered by the material web which wraps around the turner bar.

The benefits to be achieved with the present invention consist, among others, in that, during infeed of a web and/or during web processing that involves varying web widths, undisrupted operation, with a decreased need for manual intervention, is enabled. This applies especially to the configuration of the printing press presented here, in which the web to be fed in is turned inward from a longitudinal side of the machine.

In one further advantageous improvement in accordance with the present invention, the turner bar is configured with openings through which air can flow. These openings are preferably embodied as micro openings. This measure makes it possible to pressurize or to supply the turner bar with air along a maximum length of the turner bar which is provided for web processing in the printing press. This compressed air supply can be provided regardless of the web width selected at the time, and without requiring that non-wraparound edge areas of the turning bar be covered. By configuring the openings as micro openings having, for example, an average maximum opening diameter of 500 μm, the leakage flows of compressed fluid in non-wraparound areas of the turning bar, and the pressure losses in the wraparound areas of the turning bar are kept low enough that a mechanical covering of non-wraparound areas is no longer required. This also facilitates the provision of a compact structure, because accessibility to the turning bar, for covering the non-wraparound areas of the bar, when shifting from one web width to another is no longer necessary.

In a further improvement in accordance with the present invention, it is also advantageous to provide a transport device, preferably between the reel changer and the printing unit, but to provide such a transport device at least around the turner bar and extending into the printing unit, for use in accomplishing a non-manual, such as, for example, motorized, infeed of a leading edge of a web. This also eliminates a regular intervening step. Particularly when combined with a turner bar that is equipped with micro openings, an undisrupted infeed is possible because the turner bar can be pressurized or supplied with compressed air over its entire length during the web infeed process and without experiencing a significant drop in pressure through uncovered areas of the turner bar.

Local conditions existing in a printing plant frequently include boundary conditions which preclude positioning of reel changers and the like in a cellar. Alternatively height may be limited by a maximum building height and/or by the height of a preexisting facility. In such cases, for example, the placement of reel changers in a cellar or the arrangement of the printing units in a so-called "table assembly," or in other words on a plane above the reel changer, must be ruled out. In such cases, it is advantageous to install the reel changer and the printing units within a shared system plane, in parterre arrangement. In contrast to printing presses arranged in such a parterre configuration, in which the reel changers are also arranged in the machine alignment, a similar printing press, also in parterre configuration, and having its reel changers arranged to the side of the machine alignment, is shorter in structure, and ordinarily requires shorter web paths. This also contributes to the most undisrupted operation of the printing press that is possible.

A further improvement of the printing press in accordance with the present invention, and which is advantageous, in terms of variable web widths, can be achieved wherein the webs or the web sections are guided to the folding unit or to the former assembly at an orientation which is 90° out of the machine alignment. In this case, the infeed direction of the former assembly is rotated 90° in relation to the machine alignment of the printing press, and can advantageously also be offset laterally from the machine alignment. In the case of varying web widths, and therefore also of varying web section widths, in the case of full webs that are four or six newspaper pages in width, for example, fold formers of a former assembly can remain stationary, while the new web sections are aligned on the former noses in the superstructure via movable turner bars.

BRIEF DESCRIPTION OF THE DRAWINGS

Preferred embodiments of the present invention are represented in the set of drawings and are described in greater detail in what follows.

The drawings show in

DESCRIPTION OF PREFERRED EMBODIMENTS

Figure 1:
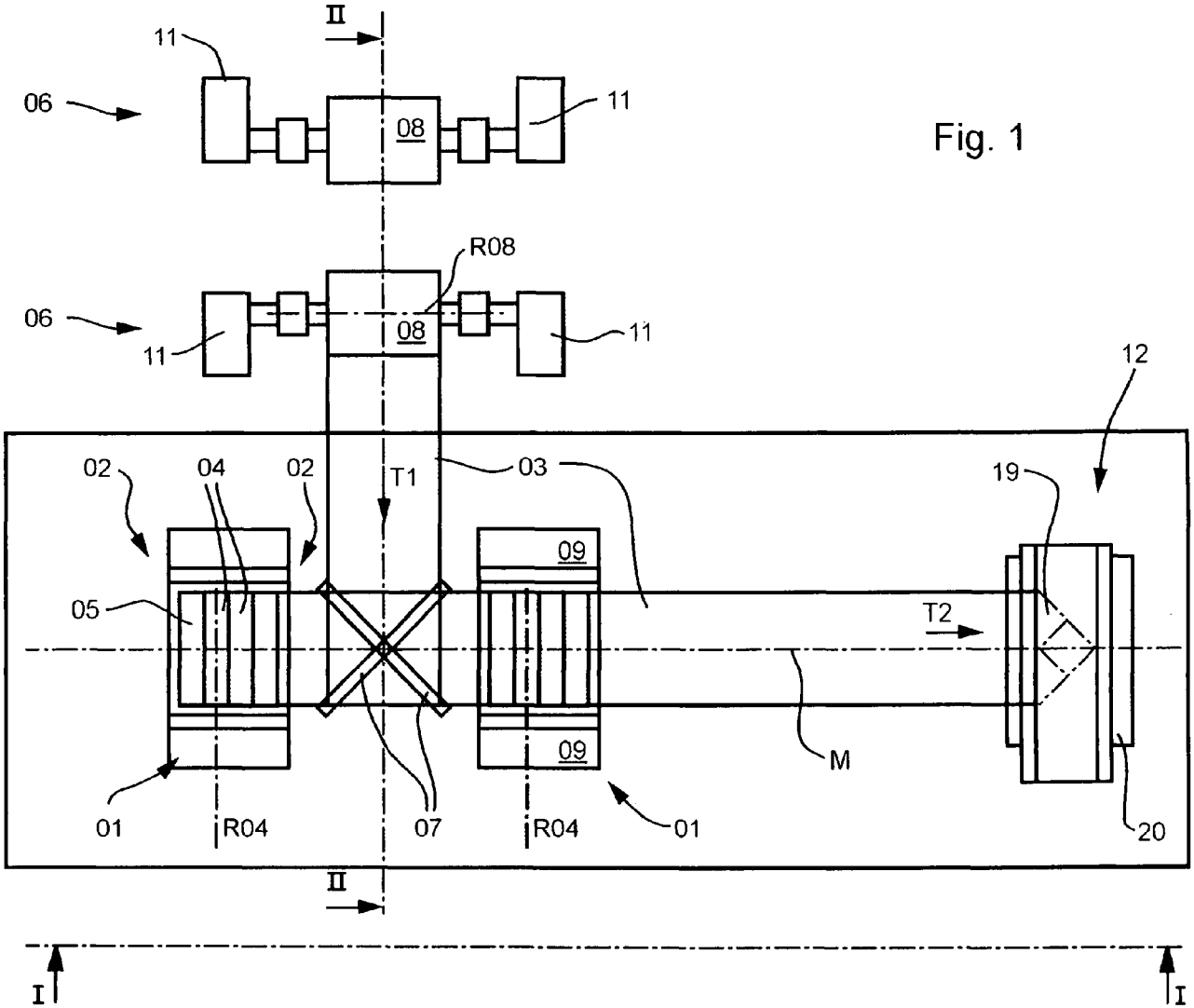
FIG. 1 a top plan view of a schematic representation of a printing press with offset reel changers.

Referring initially to FIG. 1, there may be seen a web processing and/or handling machine, such as, for example, a printing press, and especially a web-fed rotary printing press. The web-fed rotary printing press has at least one web processing and/or handling unit 01, especially a printing unit 01 with one or more printing couples 02, through which a material web 03, for example a paper web 03, which will be referred to hereinafter as web 03, can be processed and/or handled, and especially can be printed. The web processing and/or handling unit 01 has at least one rotating processing tool 04, such as, for example, a printing couple cylinder 04, which cooperates with the web 03.

Figure 8:
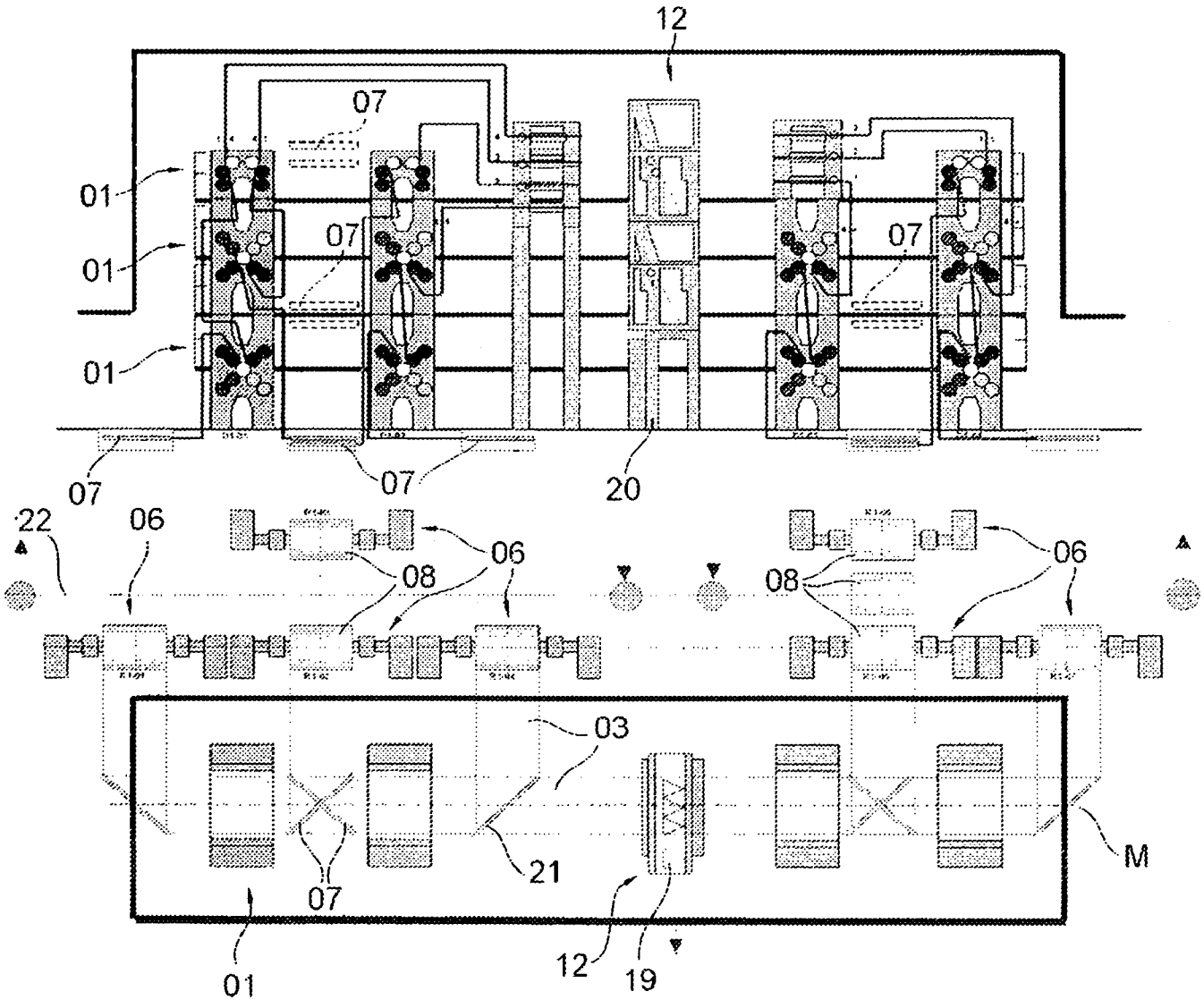
in FIG. 8 another preferred embodiment of a printing press with reel changers offset laterally in relation to the machine alignment.
Figure 15:
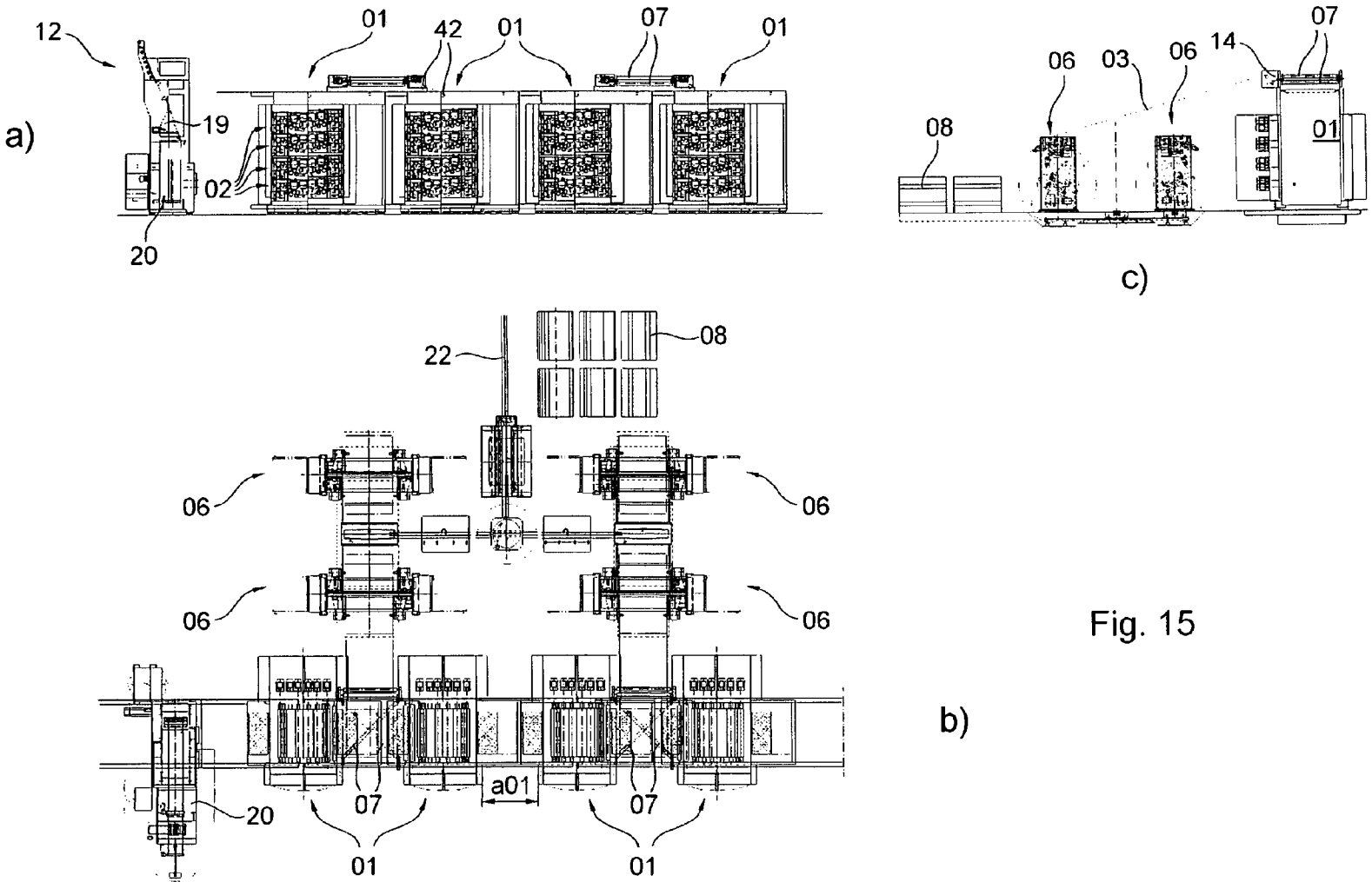
in FIG. 15 another preferred embodiment of a printing press with reel changers offset laterally in relation to the machine alignment; and in FIG. 16 a web lead with a turner bar assembly arranged above the printing unit and a web lead through the print positions from bottom to top.

A plurality of printing units 01 can be stacked to form a printing tower, such as may be seen, for example, in FIG. 8, or a plurality of printing couples 02, such as, for example, four such blanket-to-blanket printing couples 02, can be stacked to form a printing tower, such as may be seen, for example, in FIG. 15. The printing tower can have two stacked satellite printing units, such as, for example, as are represented in FIG. 8, or can have a plurality of blanket-to-blanket printing couples, for example four such printing couples, for use in double-sided printing. For example, four pairs of printing couples, as represented by way of example in FIGS. 15 and 16, can be provided with each having two printing couples that cooperate with their transfer cylinders as a blanket-to-blanket print position.

FIG. 1 shows a web-fed rotary printing press comprising a plurality of printing units 01, in this case two such printing units 01. At least two of these printing units 01 are arranged side by side in the same machine alignment, viewed in a direction which is perpendicular to the rotational axis R04 of the respective printing couple cylinders 04. In both FIG. 1 and FIG. 2, a machine center plane M of the machine alignment is shown, which machine center plane M extends, for example, perpendicular to the rotational axes R04 of the printing couple cylinders 04 of the at least two printing units 01 and also extends through the center section of the usable cylinder length of the printing couple cylinders 04.

In the example of printing couples 02, which are represented as being configured as offset printing couples, the printing couple cylinders 04 that cooperate with the web 03 are configured as transfer cylinders 04, each of which cooperates with a forme cylinder 05 that carries a printing forme. In the case of printing couples 02 which are configured as direct printing couples, such as, for example, intaglio, planographic or letterpress printing couples, the printing couple cylinders 04 that cooperate with the web 03 can also be configured as the printing couple cylinders that each carry the printing forme.

Figure 3:
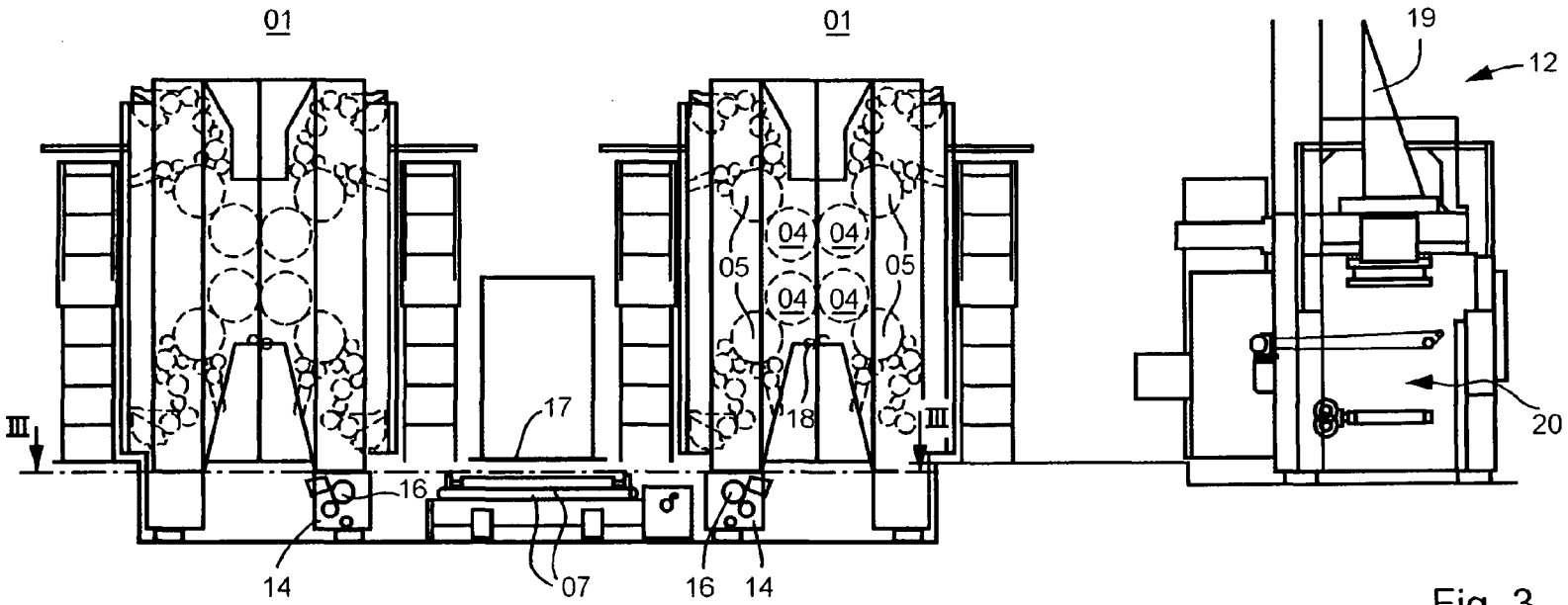
in FIG. 3 a detailed representation of a printing press, depicting a side elevation view of the printing press represented schematically in FIG. 1 and taken along line I-I in FIG. 1.

The printing unit 01 receives the web 03 for printing from at least one reel stand 06 for a web 03 that is to be unwound. At least one deflection bar 07, such as, for example, at least one turner bar 07, is situated in the web path between reel stand 06 and printing unit 01. Turner bar 07 is inclined or angled at 45° in relation to the direction of transport T1 of the web 03 running up to it from the reel stand 06. Preferably, only one turner bar 07 is provided in the path of one web 03 between its reel stand 06 and the printing unit 01, and is inclined or is angled at 45° in relation to the respective direction of transport T1 of the incoming web 03. The turner bars 07 are arranged "horizontally" within a horizontal plane. In other words, a longitudinal axis L, as may be seen, for example, in FIG. 5, of the turner bar 07 lies within a horizontal plane E, as seen in FIG. 3. In the space between two printing units 01, two turner bars 07, which are crossed in relation to one another, can also be provided. These two turner bars 07 lie in two horizontal planes E that are spaced from one another. The turner bar 07 has an active length L07, for example, over which active length L07 it is equipped with measures for producing a reduced-friction deflection, for example, on which active length L07 it has a surface through which air can flow.

The reel stand 06 is preferably configured as a reel changer 06. It may be configured, for example, as a stationary reel changer. Preferably, the reel stand 06 is configured as a reel changer 06 for changing reels at production speed and is thus capable of accomplishing a "flying" reel change. The printing unit 01 and the reel changer 06 that supplies the web 03 to the printing unit 01 are arranged offset from one another, as viewed with respect to the direction of the rotational axes R04 of the printing couple cylinders 04. In particular, the printing unit 01 that comprises side frames 09 at its end surfaces, and the reel changer 06, that comprises end surface side frames 11, are arranged spaced from one another, when viewed in the direction of the rotational axes R04 of the printing couple cylinders 04. In the case of a plurality of printing units 01, which are all arranged in one machine alignment, the reel changer or changers 06 is or are arranged laterally next to the machine alignment, as may be seen in FIG. 1. The reel changer 06 is oriented in such a way that the rotational axis R08 of a reel 08, such as, for example, of a material reel 08 or of a paper reel 08, which is carried by the reel changer 06, is oriented substantially perpendicular to the rotational axis R04 of the printing couple cylinder 04 that is allocated to the same web path.

Figure 2:
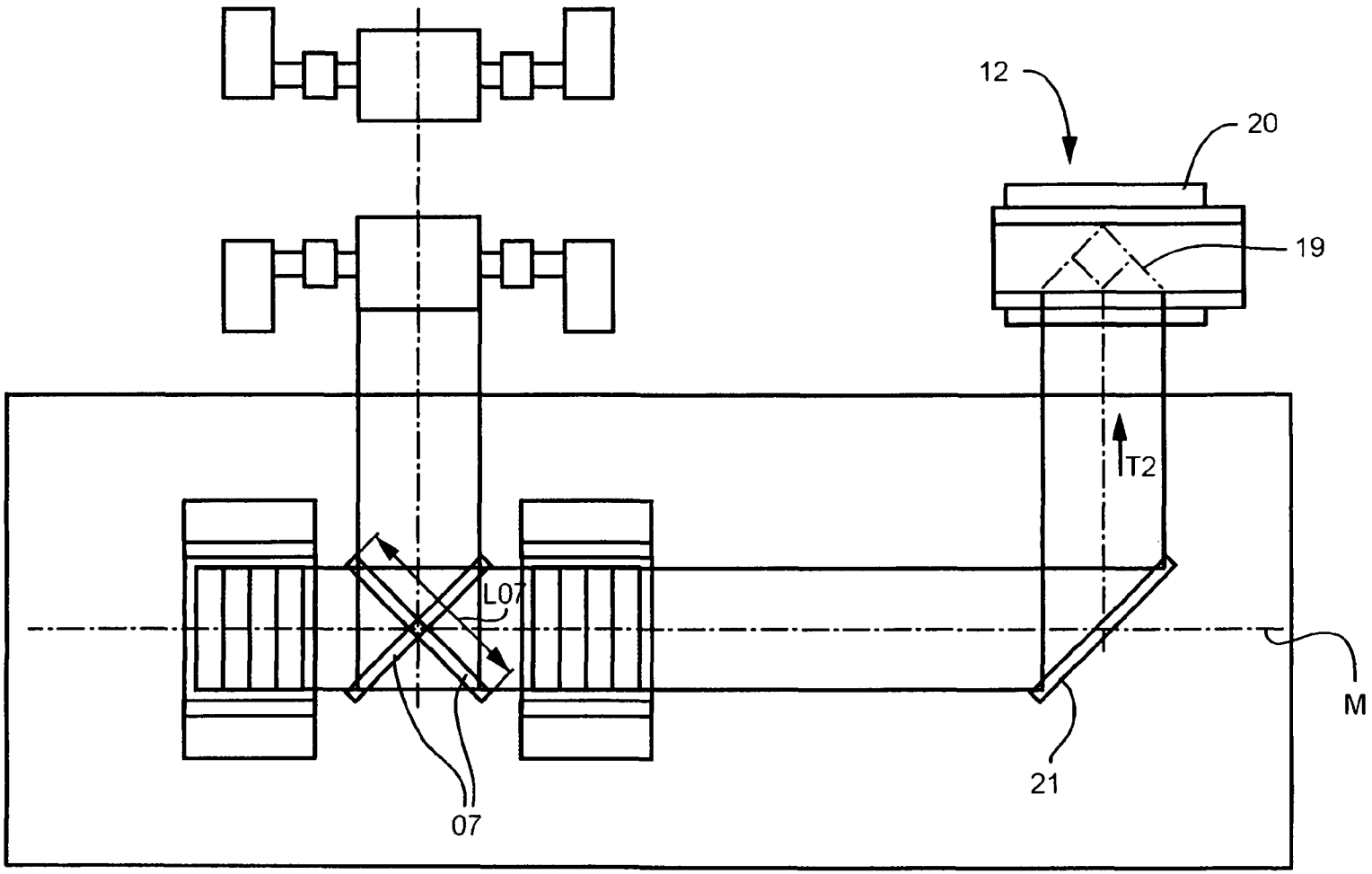
in FIG. 2 a top plan view of a schematic representation of a printing press with offset reel changers and an offset former assembly.

After the web 03 has passed through the printing units 01 and, if applicable, through a superstructure, which is not specifically represented in detail in FIG. 1, the now printed web 03 is fed to a former assembly 12 that has one or more fold formers 19 and then, if applicable, web 03 is fed to a folding unit 20 which is situated below this former assembly 12 for the purpose of further processing. In FIG. 1, the former assembly 12 or its fold former 19 is oriented in such a way that a direction of transport T2 of a web 03 running up to the fold former 19 lies within a plane that is parallel to the machine center plane M or which coincides with it. In a preferred embodiment that is advantageous with respect to a compact construction and/or with respect to variable web widths, the former assembly 12 or its fold former 19 is oriented, as is depicted in FIG. 2, in such a way that a direction of transport T2 of a web 0, which is running up to the fold former 19, lies within a plane that is perpendicular to the machine center plane M. In this case, the web 03, or web sections which have been generated from the web 03 by the imposition of a longitudinal cut, are guided over one or more turner bars 21 which are arranged in the superstructure. The web 03, or the web sections are thus diverted 90° from their previous direction of transport toward the former assembly 12. It is also possible, for example, to provide a turner bar 21 which is at least four or even six newspaper pages in width, rather than turner bars 21 that are two pages in width, in the projection of the incoming web 03. A full web 03, which has not yet been cut and which is four or six newspaper pages in width, can be diverted, by the turner bar, to the former assembly 12.

The former assembly 12 can have one or more, for example, two, three or even four fold formers 19, which may be arranged side by side horizontally, and which are situated transversely to the direction of transport T2 from the same machine plane, as indicated by a dotted-dashed line in FIG. 2. Moreover, the former assembly 12 can have a plurality of planes, with one positioned above another vertically, each with one or more fold formers 19.

Figure 4:
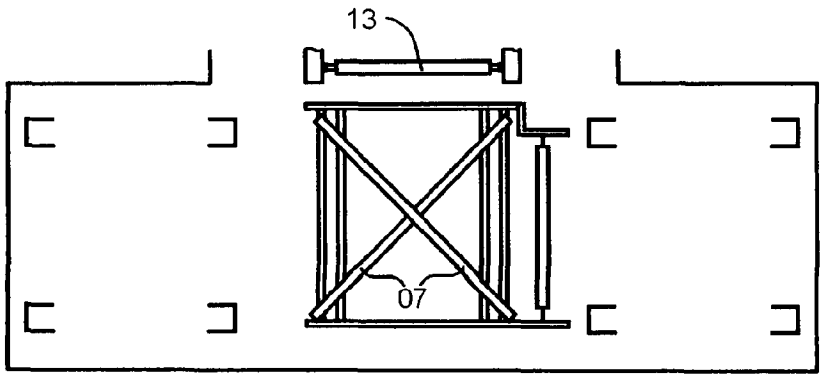
in FIG. 4 a sectional representation taken along line III-III of FIG. 3.
Figure 5:
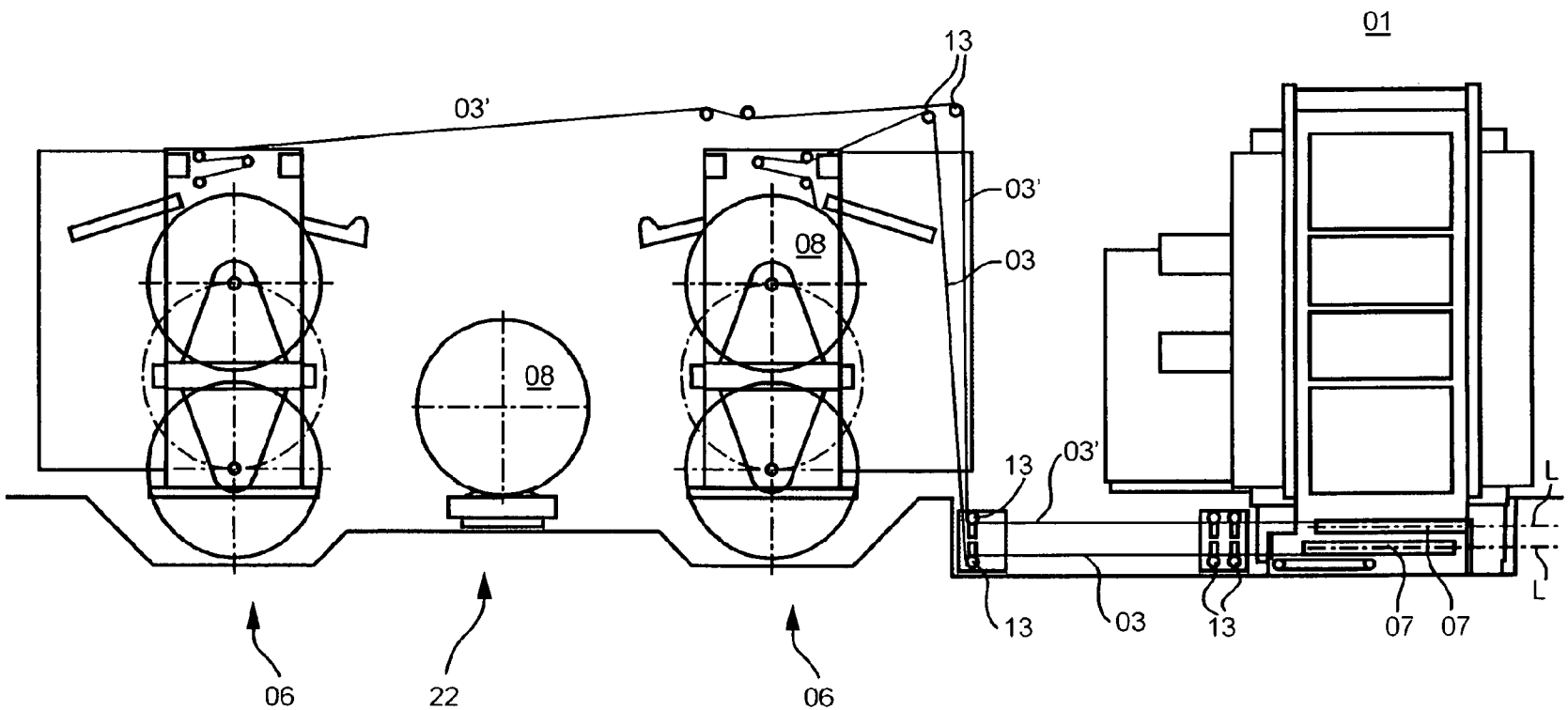
in FIG. 5 a detailed representation of a printing press, and taken along line II-II of the printing press represented schematically in FIG. 1.

In FIGS. 3 through 5, additional views of a printing press are shown. FIG. 3 shows a detailed representation of a printing press, meant to correspond to a side elevation view of the printing press represented schematically in FIG. 1, and taken along line I-I in FIG. 1. FIG. 4 shows a sectional representation of the printing press taken along line III-III of FIG. 3. FIG. 5 shows a detailed representation of the printing press of FIG. 3, which is meant to correspond to a view, taken along line II-II of FIG. 1, of the printing press which is represented schematically in FIG. 1.

As can be seen in FIG. 5, a web 03 is wound off of a reel 08 which is carried in the reel changer 06, and is guided over a plurality of guide or deflection rollers 13, such as, for example, an upper and a lower deflection roller 13, which are close to the reel changer, and at least one deflection roller 13 that is close to the turner bar, and which rollers 13 direct the web 03 to the turner bar 07. Advantageously, the deflection rollers 13, and especially the last deflection roller 13 situated upstream from the turner bar 07, are arranged in such a way that the web 03 runs up to, or arrives at the turner bar 07 in a horizontal direction of transport. Once the web 03 has passed around the turner bar 07 and has altered its direction of transport by 90°, it is fed from there to the printing unit 01. An infeed unit 14, as seen most clearly in FIG. 3, is preferably arranged in the web path between the turner bar 07 and the point of intake into a first printing couple 02 of the printing unit 01, which cooperates with the web 03. The infeed unit 14 has at least one drawing roller 16, which is driven by a motor that is not specifically shown in FIG. 3. Depending upon the orientation of the turner bar 07 that is wrapped by the web 03, the web 03 is diverted to the left or the right as it passes around the bar. The turner bar assembly, which is provided adjacent to a printing unit 01 or which is located in the space between two printing units 01, as viewed in the machine alignment, can have one or more turner bars 07, arranged, for example, below an operating platform 17 for the adjacent printing couples 02, which operating platform 17 can be accessed by the press operator and which is depicted schematically in FIG. 3 and in FIG. 6. The operating platform 17 can have flaps that can be opened to access the turner bar assembly. These flaps are shown opened in FIG. 6*a*.

In the embodiment of the present invention, as depicted in FIGS. 1-5, a turner bar assembly, with two turner bars 07 arranged vertically one above another, is provided next to the printing unit 01 or is provided between two adjacent printing units 01. Each of the two turner bars 07 of this turner bar assembly receives a web 03 or 03' from one of the two reel changers 06 which, as seen in FIGS. 1 and 2, are arranged one in front of another in an alignment that extends perpendicular to the rotational axis R08 of the reel 08, in what may be referred to as a "tandem assembly". In the embodiment of the present invention and having a turner bar assembly with two crossed turner bars 07 and with two reel changers 06 in tandem arrangement, a first web 03 coming from a first one of the reel changers 06 can be supplied to a first printing unit 01, which is on the left, as viewed from the reel changer 06, while simultaneously a second web 03' coming from the other, second reel changer 06 can be supplied to a second printing unit 01, which is on the right as viewed from the reel changer 06. If only one reel changer 06 is provided at the level of two crossed turner bars 07, then, when the web 03 is fed in, that web 03 can be directed optionally either to the right printing unit 01 or to the left printing unit 01 by selecting the turner bar 07, which web 03 is to be wrapped around, without pivoting the turner bar 07. In principle, it is necessary only for one turner bar 07 to be provided for each laterally offset reel changer 06. After passing around the turner bar 07, and especially after the infeed unit 14, the web 03 can be guided over one or more additional deflection rollers 18 to the first printing couple 02 through which it is to pass. This can be a printing couple 02 at the bottom, as in FIG. 5, but can also be another one of the provided printing couples 02.

With either a manual or an automated reel loading device 22, as seen schematically in FIG. 5, platforms for use in furnishing reels 08 can be provided. In the case of an automatic reel loading device 22. These platforms can be a conveyor system, which has transfer cars that are guided, for example, in tracks. The two reel changers 06, which are arranged in tandem, as depicted in FIG. 5, for example, point, with their loading side, toward a shared platform that lies between them. This shared platform, or a part of a reel loading device 22 that is provided in the platform, can then be used for both reel changers 06.

Figure 7:
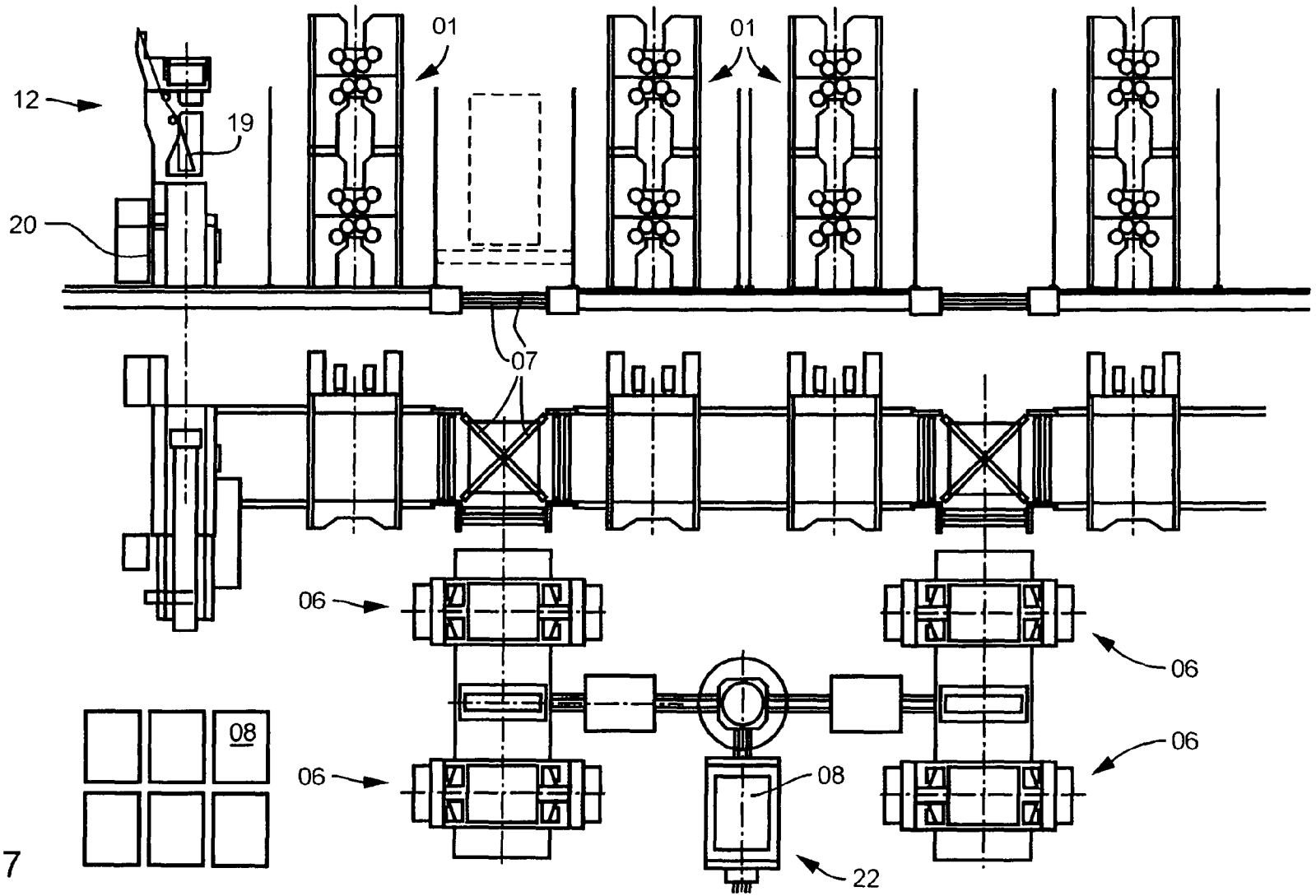
in FIG. 7 a second preferred embodiment of a printing press with reel changers offset laterally in relation to the machine alignment, from a side view and a plan view.

FIG. 7 shows a further preferred embodiment of a printing press, in accordance with the present invention, with reel changers 06 which are offset laterally in relation to the machine alignment. In this case, printing towers, which are each comprised of two stacked printing units 01, are provided. As indicated by dashed lines, another printing press unit can be provided above the turner bar assembly in an intermediate plane, such as, for example, at a level less than two meters from the plane that holds the printing towers. This is possible and advantageous, especially when the requirement for ready accessibility of the turner bar assembly is low. This is particularly the case when a turner bar 07 is used which has micro openings, as will be discussed below, and/or with a non-manual, such as, for example, with a motorized, infeed. The unit could be configured, for example, as a former assembly 12 and/or a folding unit 20.

FIG. 8 shows a further preferred embodiment of a printing press with reel changers 06 which are offset laterally in relation to the machine alignment. In this embodiment, printing towers, each comprised of two stacked printing units 01, and especially satellite printing units, and in some cases also with a six-cylinder supplementary printing couple, are provided. A web width for the machine, which web width corresponds to the width of six newspaper pages, is indicated here by way of example. In this case, the longitudinally cut web 03 is then fed to a former assembly 12 having three fold formers 19 which are positioned side by side. A fourth former can optionally be provided adjacent to these three fold formers 19.

Also shown, by way of example in FIG. 8, is the turner bar assembly 07, which is indicated by dashed lines, and which is situated in an alternative position within a plane at the level of the printing tower. This level of the turner bar assembly 07 may be a level that is above the printing couple cylinder 04 of the lower printing unit 01, and below the printing couple cylinder 04 of the upper printing unit 01. Also by way of example, in another alternative for the location of the turner bar assembly 07, which is also represented by dashed lines in FIG. 8, the turner bar assembly is now represented by dashed lines as being located above the uppermost print position, or printing couple cylinder 04, of a printing tower. What is described below in connection with FIGS. 15 and 16 can then be correspondingly applied to these alternative locations for the turner bar assembly.

FIG. 15 illustrates a further preferred embodiment of a printing press with reel changers 06 which are offset laterally in relation to the machine alignment. In this embodiment, the turner bar 07, which is arranged in the web path between reel stand 06 and printing unit 01, is arranged at a level of the machine that is above the level of printing couples 02, and especially at a level which is above the last printing couple 02 or its printing couple cylinders 04. This embodiment is particularly space-saving, because the space, such as, for example, a distance a01 between two adjacent printing units 01, as shown in FIG. 15*b*, can be narrower in configuration and/or can be used for a different purpose. The turner bar assembly can also be arranged above the intermediate space between two printing units 01, overlapping one or two printing units 01, or even can be situated directly above a printing unit 01. In particular, a turner bar assembly with two crossed turner bars 07 can be arranged in the above-described manner. The reel changers 06 can be provided in a gate arrangement, as represented, such as, for example, with two reel changers 06 positioned one in front of another in an alignment that is perpendicular to the machine center plane M. However, rather than having two turner bars 07 of this type in each such turner bar assembly, only one turner bar 07 of this type may also be provided, with which single turner bar only one web 03 is then turned inward laterally.

Figure 16:
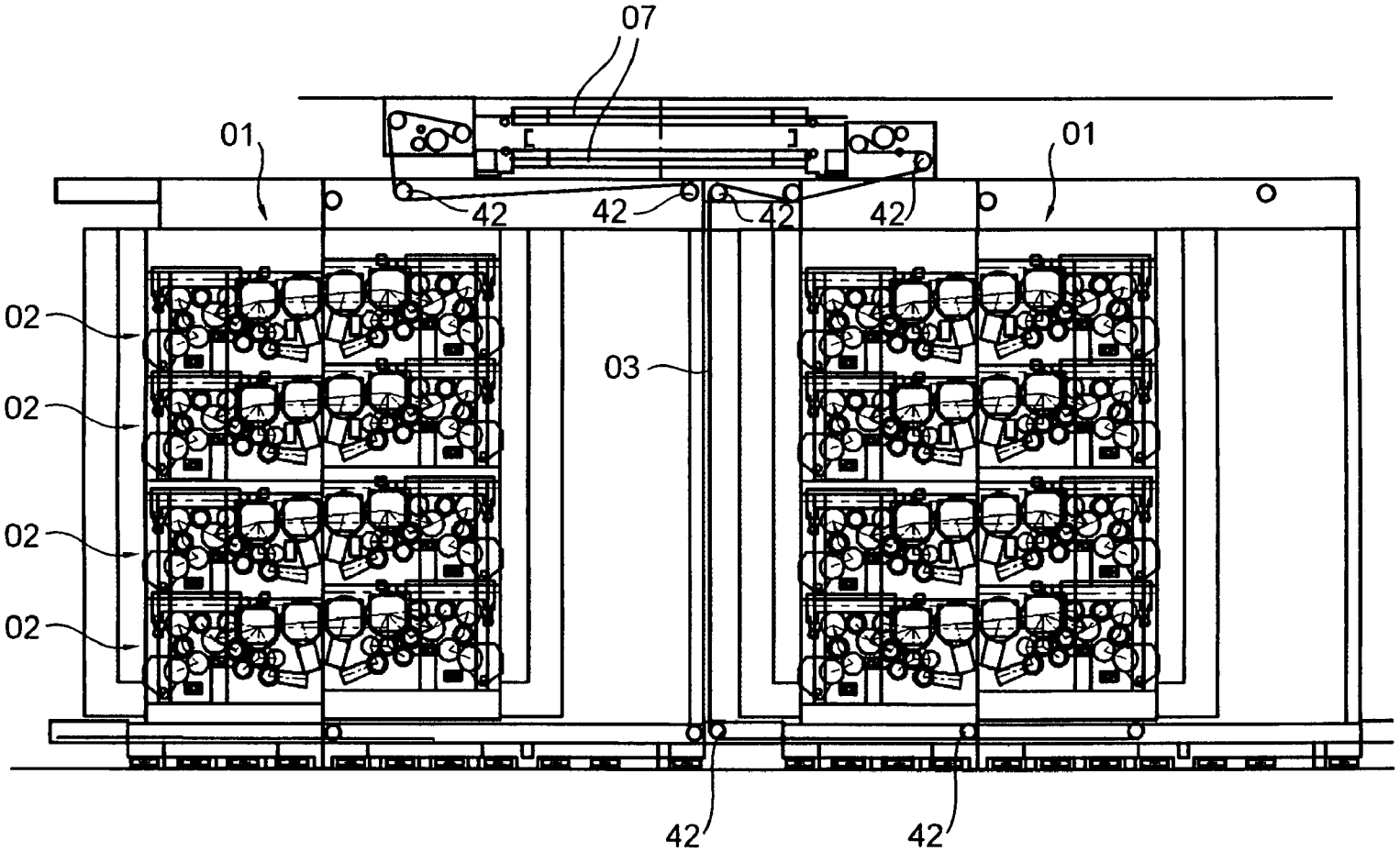

After passing around the turner bar 07, the web 03 can be guided from the top of the machine, via one or more deflection rollers 42 or deflection rods that extend parallel to the printing couple cylinders 04. The web 03 is thus guided into the printing unit 01, passing through the printing unit 01 from "top to bottom", as seen in FIG. 15*a*. However, web 03 can also be guided downward outside of the printing unit 01 via a deflection roller or rod 42 that extends parallel to the printing couple cylinders 04. Web 03 can then be guided, via additional deflection rollers 42 or rods of this type, from the bottom into the printing unit 01, passing through the printing unit 01 from "bottom to top", as seen in FIG. 16.

As can be seen in FIG. 15*c*, in the case of a turner bar 07 which is arranged above the printing unit 01, the infeed unit 14 can also be provided above the printing unit 01 or can be located at an upper end of the printing unit 01.

With this arrangement of the turner bar or bars 07 above the plane of the printing unit 01, a compact arrangement, with respect to the web leads and web lengths, and with respect to the number of guide elements, the web tension, and the like is provided. No cellar or other provisions in the area of the operating platform 17 are necessary. On the web path from the reel changer 06 to the printing unit 01, a deflection of only 90° is necessary. In this elevated arrangement, the turner bar 07 can be conventionally configured. However, in an advantageous further improvement the turner bar 07 can be configured as will be described in what follows. It is also advantageous, especially due to the provision of a path between reel changer 06 and turner bar 07 that must be bridged, to provide a transport device 31 for a non-manual infeed, as will be discussed below.

In one particularly advantageous embodiment of the present invention, and especially with respect to variable web widths and/or an automatic infeed, the turner bar 07 has outlet openings 23, which may be embodied as micro openings 23. Outlet openings 23, which are intended for the passage of a pressurized fluid, and may be configured, for example, as air outlet openings 23, are located at least in an angular wraparound region of the web 03, for example in an angular region of less than 270°. In this case, micro openings 23 are understood as being openings on the surface of the component, which micro openings 23 have an average diameter of less than or equal to 500 μm, advantageously have an average diameter less than or equal to 300 μl, and especially have an average diameter less than or equal to 150 μm.

Figure 10:
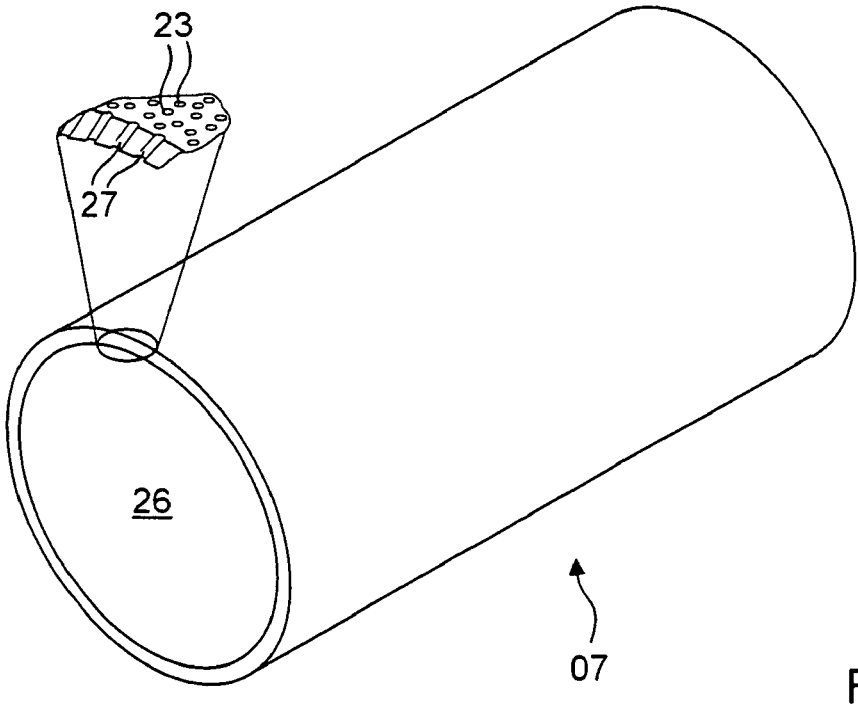
in FIG. 10 a perspective view of an embodiment of a turner bar with microscopic holes.

In a preferred embodiment of the present invention, which is represented in FIG. 10, the micro openings 23 can be configured as openings of microscopic holes 27, which extend toward the outside of the turner bar 07 through a wall that borders an interior space 26 of the turner bar 07, which interior space 26 is configured, for example, as a pressure chamber. When this interior space 26 is pressurized with gaseous fluid, such as, for example, compressed air, which is at an elevated pressure of, for example, more than 4 bar, and especially at an elevated pressure of 4.5 to 7 bar, in relation to the surrounding air, this pressurized fluid flows through the microscopic holes 27 and forms an air cushion on the surface of the turner bar 07. The microscopic holes 27 can have a maximum hole diameter of, for example, 500 μm, preferably have a hole diameter of, for example, 60 to 100 μm, and especially have a hole diameter of approximately 80 μm. The open surface in the perforated area of the outer surface can amount to 0.01 to 0.05%, especially approximately 0.03%.

In the wraparound area of the turner bar 07, areas with different levels of perforation, such as, for example, areas with different hole number densities and/or hole diameters, can be provided for different angular regions. These different areas can be, for example, the web lead-in area, the trailing area of the web, or an area of the turner bar 07 that lies between these lead-in and trailing areas and which is wrapped by the web.

The microscopic holes 27 can be produced using a process in which the surface to be perforated, which may be, for example, a 2-3 mm thick aluminum sheet or pipe or pipe segment, is perforated using an electron beam. Alternatively, perforation of the turner bar 07 can also be achieved using an etching technique. However, in this case, the thickness of the material to be perforated, such as a sheet, a pipe, or a pipe segment should be less than 2 mm in the area to be perforated. In particular, such a thickness should not exceed 1.5 mm.

Figure 9:
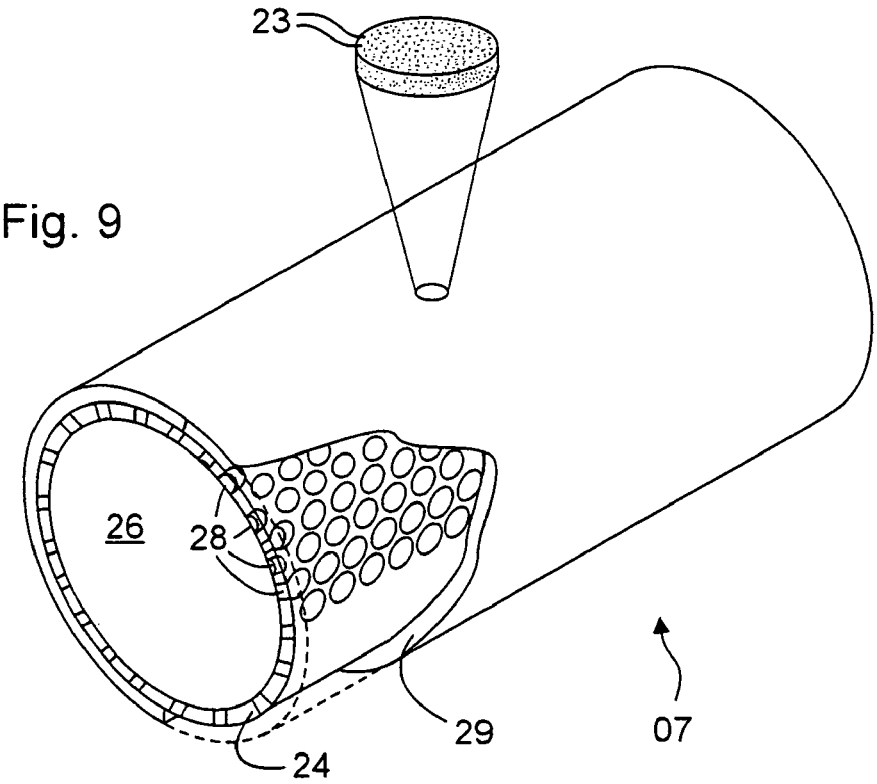
in FIG. 9 a perspective view of an embodiment of a turner bar with microporous material.

In contrast to the depiction shown in FIGS. 9 and 10, the turner bar 07 can also have a circle segment profile rather than an annular cross-section, with an angular region being configured as a circle segment, for example, as a segment of at least ≧180°, and especially of from 180° to 270°, with the open chord having a straight termination.

In the embodiment of the present invention, which is represented in FIG. 9, the turner bar 07 has a main body 24 with an interior space 26, for example a tubular main body 24, and with openings 28 that extend radially through the main body 24. In at least the section that is equipped with the openings 28, the main body 24 is provided with a microporous layer or coating 29, the open pores of which microporous layer 29 form the air outlet openings 23. The layer 29 covers the main body openings 28 and extends continuously over at least the area of the turning bar 07 that cooperates with the web 03, thus forming a continuous surface, at least in the angular region of the turning bar 07, which is provided for wraparound by the web 03 to be fed in. In one variation, however, openings 28 and microporous layer or coating 29 can also be provided around the entire 360° angular region of the turning bar 07. Of particular advantage is an embodiment of the present invention in which the openings 28, or the microscopic holes 27 in the above example, extend only around a partial angular region of the turner bar 07, and especially at least in the wraparound angular region, but the layer 29 is applied to the full circumference, so that the main body 24 is covered over its entire circumference.

In connection with the handling of variable web widths, such as, for example, in an embodiment of the printing press for use in the printing of full webs 03 of different widths, such as, for example, for producing different product formats, it is advantageous for the active length L07 of the turner bar 07 to be sized to match the maximum web width which will be provided for processing. The openings 28 or the microscopic holes are thus to be provided over a length L07 of the turner bar 07 which length L07, in projection on the width of the incoming web 03, corresponds to at least the maximum web width. This maximum web width can correspond, for example, to the width of at least two, or for example to a width of four, six or even eight newspaper pages in a specific print format such as, for example, a broadsheet format). If a narrower web 03, for example having the width of the same number of pages, but in a smaller print format, or having the width of a smaller number of printed pages, is to be fed to, and deflected by the turner bar 07, then edge areas of the turner bar 07 that are not wrapped need not be covered, as is otherwise customary. This is because the special structure of the air outlet openings 23 as micro openings 23, such as open pores or microscopic holes 23, results in only low leakage flows and results in low pressure losses. In one operating situation, for processing a preferably full web 03, that is narrower than the maximum possible web width, the turner bar 07 is charged or pressurized with compressed air over its entire length L07 that is equipped with micro openings. This pressurized or compressed air exits through the micro openings 23 over the entire length L07 of the turner bar 07 that has micro openings 23. However, in the uncovered edge areas of the turner bar 07 only a slight leakage flow through the uncovered micro openings 23 occurs.

The microporous layer 29 is made, for example, of a porous material. Advantageously, the layer 29 is made of a sintered material, especially is made of a sintered metal. In this case, the porous material advantageously has pores having an average pore size of 5-50 μm, and especially having a pore size of 10-30 μm. A degree of openness on the outward facing surface of the porous material lies between 3% and 30%, and preferably lies between 10% and 25%.

In a variation of the present invention which is not specifically represented here, the turner bar 07, in the embodiment with micro openings 23, can also have another special surface coating which particularly promotes the sliding of the web. One example of this embodiment would be the provision of a surface coating of a material of, for example 1.5 to 4 mm thick, and especially of 2 to 3 mm thick, and, for example, with a circular or a circle segment profile, such as, for example, an aluminum profile, with a glass bead structure. A coating that increases wear resistance can also be applied to this structure. In a further improvement, it is possible to provide a blowing device in the area shortly in front of, or directly in the winding gap of the web to the turner bar 07, with which blowing device air can be blasted under the web, and which air is carried along by the web to support the formation of an air cushion between the turner bar surface and web.

In an advantageous further improvement in accordance with the present invention, in the web path from the reel changer 06 up to the point of infeed into the printing unit 01, a transport device 31 is provided for accomplishing a non-manual, such as, for example, a motorized, infeed of a leading edge of a web. This transport device 31 preferably also extends at least in the web path up to behind the printing unit 01. In principle, with respect to the turner bar 07, this transport device 31 can be independent of the special configuration of the turner bar 07 with micro openings 23. However, this further improvement is particularly advantageous when it is combined with the configuration of the turner bar 07 with micro openings 23.

Figure 11:
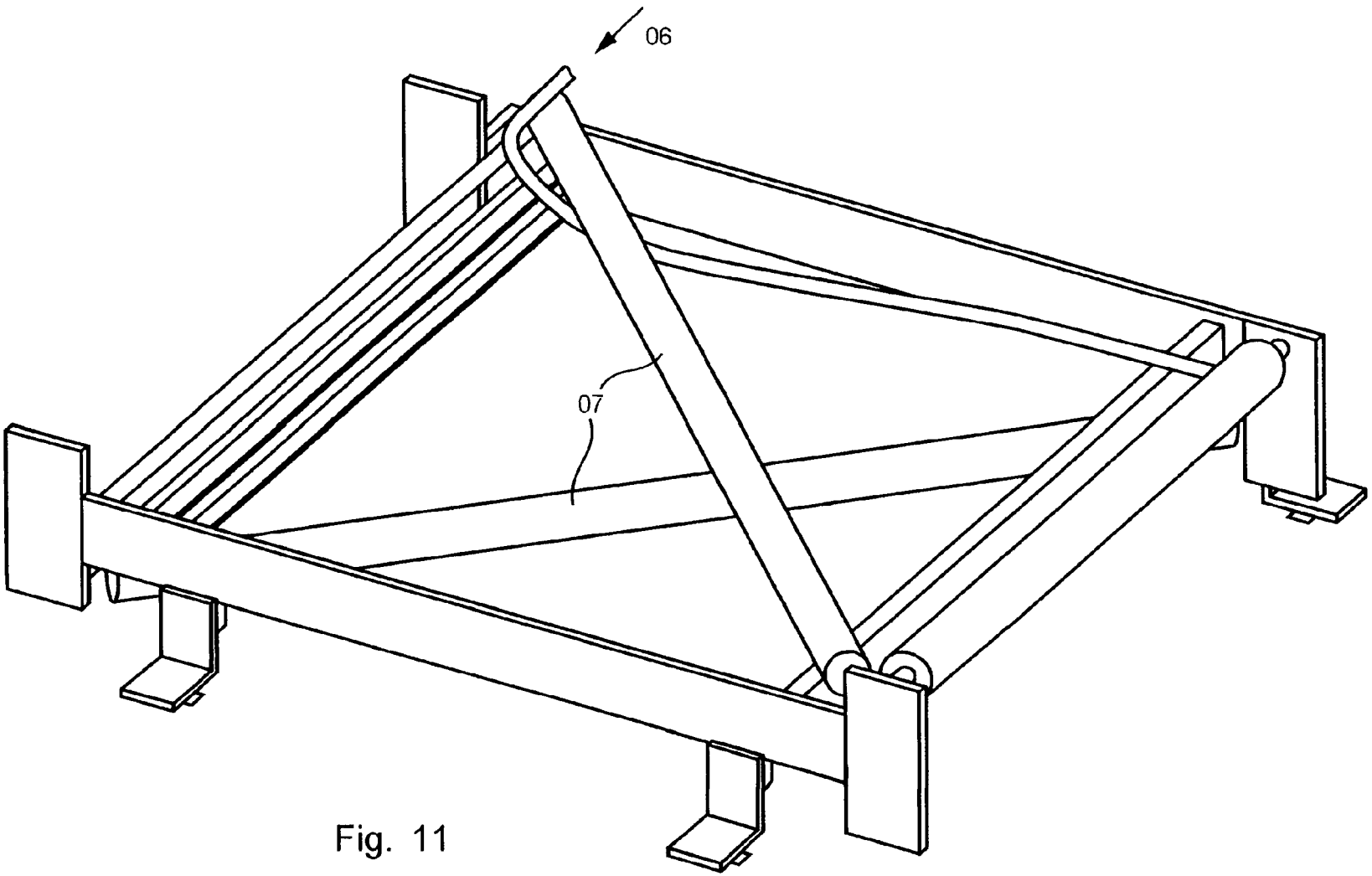
in FIG. 11 an oblique perspective view of a turner bar looped by a chain guide.

In an embodiment of one of the two crossed turner bars 07, represented by way of example from a perspective view in FIG. 11 and correspondingly applicable for the other turner bar and also in the case of a turner bar assembly having only one turner bar 07, the transport device 31 is configured as a guide 32, such as, for example, a chain guide 32, which may be provided with an endless chain 33, such as, for example, with an infeed chain 33, which is not specifically shown in FIG. 11, which infeed chain 33 can be transported in the guide 32. Coming from the reel changer 06 or from the upper deflection roller 13, the chain guide 32 passes around an edge area of the turner bar 07 on a substantially helical or spiral path of approximately 90 to 115°, before proceeding along a substantially horizontal path to the second turner bar 07, which it also passes around in its upper edge area on a substantially helical or spiral path of approximately 90 to 115°.

Figure 12:
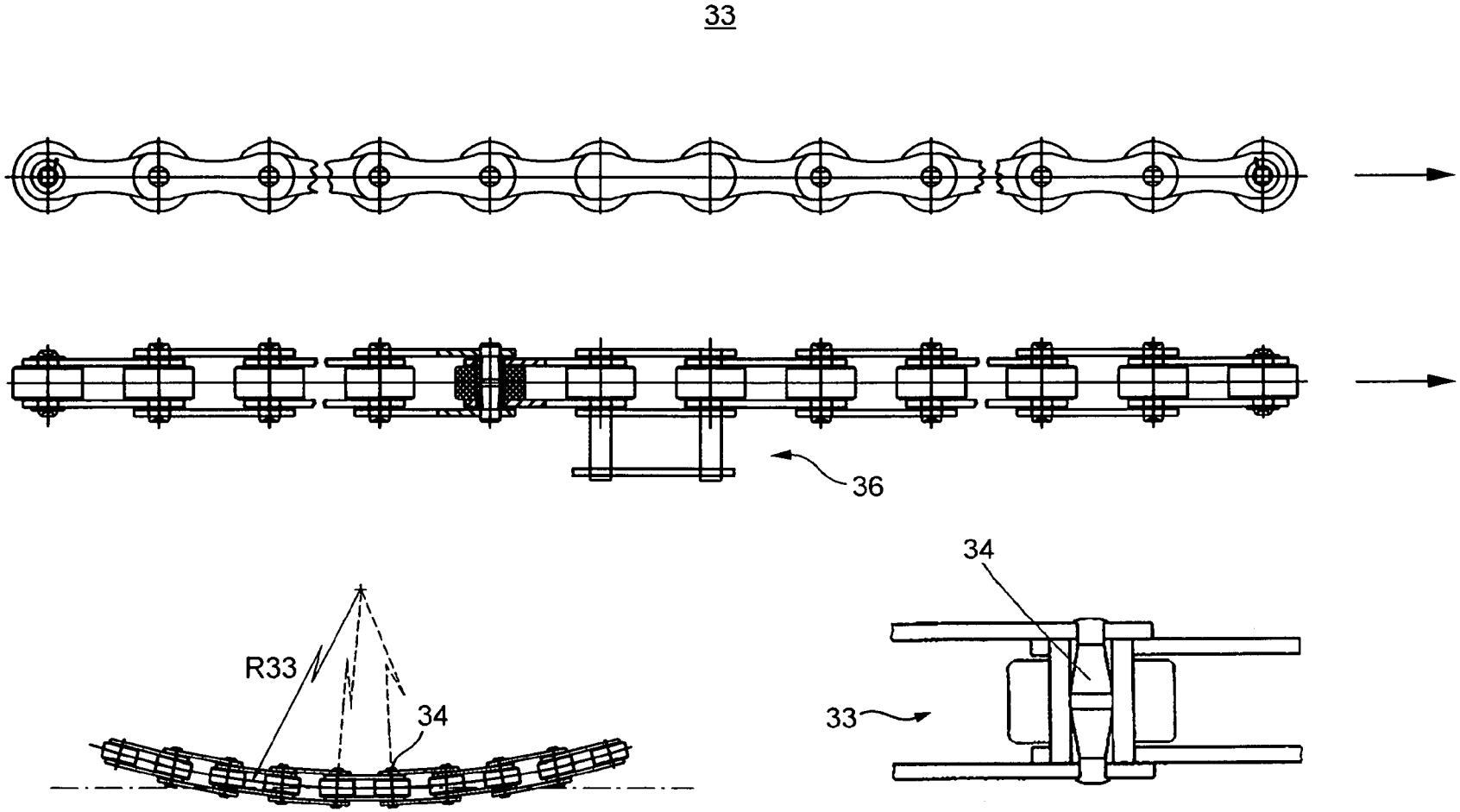
in FIG. 12 an embodiment of an infeed chain.

To enable the helical or the spiral path of the infeed chain 33 in the guide 32, the guide 32 is preferably configured such that it can be bent in two spatial directions that are perpendicular to its direction of transport, at least around a maximum radius of curvature of 1,000 mm. One advantageous embodiment of the chain 33 that can be guided in the guide 32 is represented in FIG. 12. The chain 33 has rollers which are mounted on pivot pins 34. The pivot pins 34 are attached, spaced from one another, via link plates. To allow the chain 33 to execute more than just a pivoting motion around the longitudinal axes of the pivot pins 34, in other words curving in a first spatial direction for example, the bore holes in the link plates are somewhat larger than the diameter of the pivot pins 34. The chain 33 can thus also bend transversely to its direction of travel or in the direction of the longitudinal axes of the pivot pins 34, in a second spatial direction. In the curved state, a maximum radius of curvature R33 of 1,000 mm, preferably less than 600 mm, and especially preferably less than 500 mm, results. The curved state for the above specifications is naturally understood as curvature in the area where forces are applied, without resulting in irreversible deformations or destruction of the chain. It is also possible to configure the pivot pin 34 to have different diameters in its longitudinal direction, and especially to configure the pivot pins 32 as being cambered.

Figure 6:
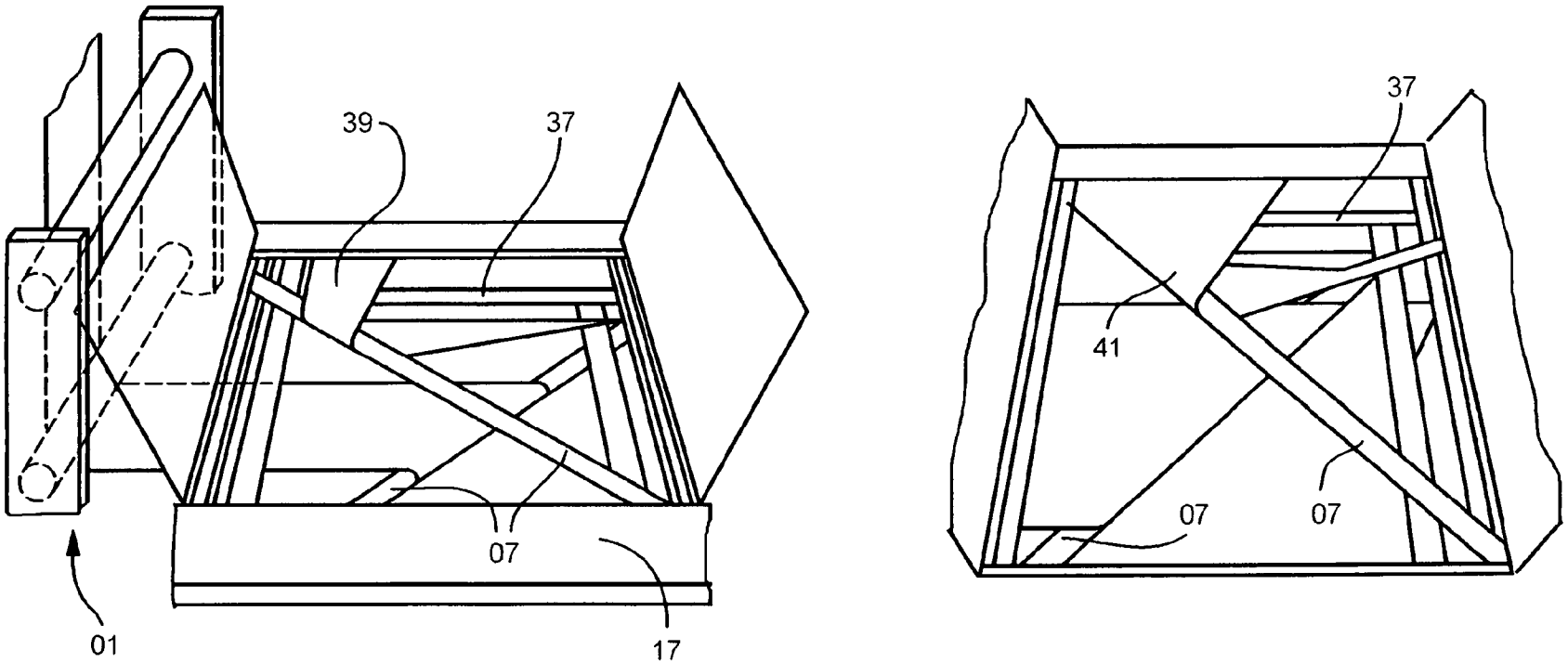
in FIG. 6*a*-6*b* perspective representations of the turner bar assembly arranged below an operating platform a) with an infeed tip and b) with an infeed apron.
Figure 13:
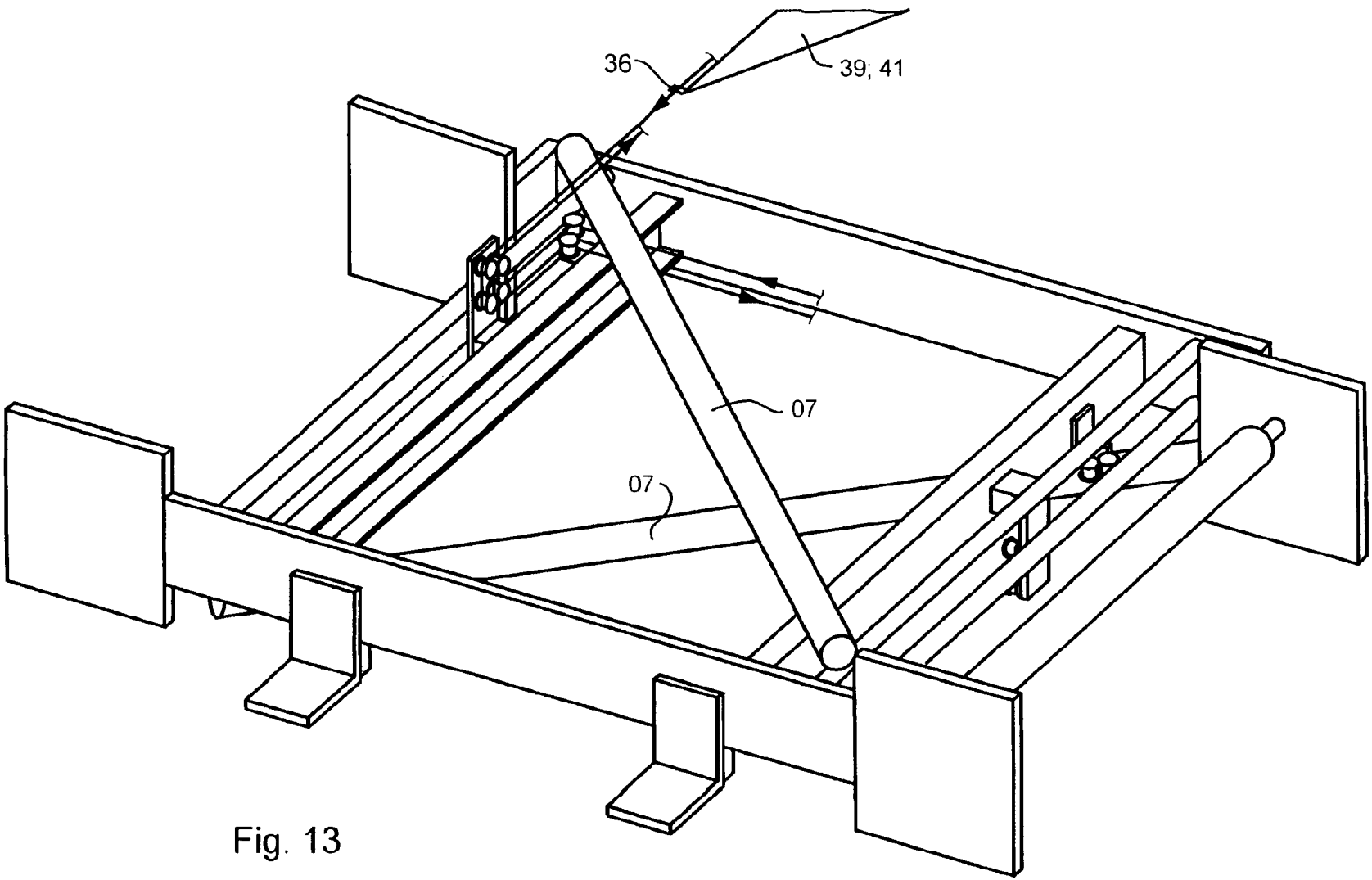
in FIG. 13 a perspective oblique view of a turner bar looped by an infeed belt.
Figure 14:
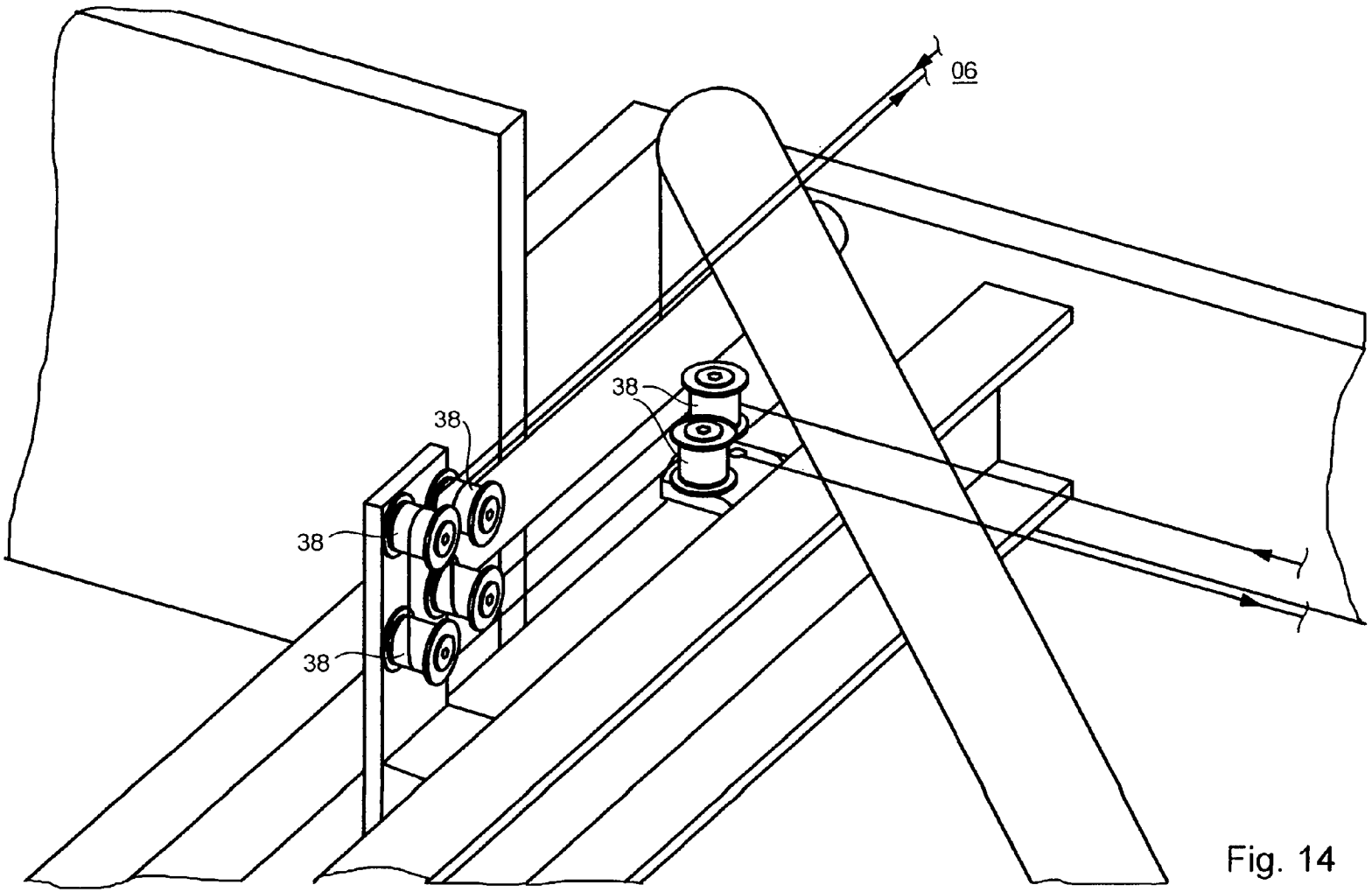
in FIG. 14 a detailed view of a portion of the turner bar and infeed belt of FIG. 13.

In an embodiment of the present invention, which is represented in FIG. 13, the transport device 31 can have a transport mechanism which is embodied as a belt 37, for example an infeed belt 37, which belt 37 is guided as either a continuous belt 37 or as an endless belt 37 to be wound on both sides over corresponding tape pulleys 38 in the web path around the turner bars 07. In FIG. 6, a belt 37 of this type is shown in the example of a circulating belt system, with branches that run upstream and downstream. In a perspective representation in FIG. 13, and in the detailed view in FIG. 14 the belt path around the turner bar 07 is added. Coming from the reel changer 06, the branch of the belt 37 that travels downstream, in the direction of transport of the web 03, is guided over two tape pulleys 38 at the height of the turner bar 07 and then undergoes a 90° change in direction over another tape pulley 38. At the same time, the branch that travels upstream, opposite to the direction of the transport of the web 03, follows the same guidance in reverse sequence. If the leading edge of a web 03 is fixed to the belt 37, as depicted schematically in FIG. 13, it is guided around the turner bar 07 and is diverted 90° from its previous direction of transport.

On the path between the reel changer 06 and the printing unit 01, full webs 03 having a width of, for example, at least two, or for example, of four, six or even eight newspaper pages in broadsheet format are fed in.

To infeed a web 03, its leading edge, such as, for example, a triangular leading edge 39; 41, is coupled to the belt 37 or to a holding element 36, indicated in FIG. 12, which holding element 36 may be, for example, a coupling, a clasp or a catch, which is carried on the chain 33. To accomplish this coupling, for example, either a leading edge of a material web is itself prepared as an approximately triangular infeed tip 39, as may be seen in FIG. 6*a*, which is equipped at its tip with an assembly that corresponds to the holding element 36, and is coupled to it. Alternatively, a triangular infeed apron 41, as may be seen in FIG. 6*b*, and which is made of a material other than paper, such as, for example, of plastic, is applied to the leading edge of the material web, and its tip is coupled to the infeed belt or to the chain 33 via an assembly that corresponds to the holding element 36. During the entire web infeed process or, for example, from the moment the infeed tip 39 or the infeed apron 41 of the web 03 begins to wrap around the turner bar 07, the relevant turner bar 07 is acted upon by compressed air. Thus, during the infeed process, air exits both from micro openings 23 in the wraparound areas of the turner bar 07, and from areas of the turner bar that are not wrapped by the web 03 or that have not yet been wrapped by the web 03, without the air cushion in the wraparound areas collapsing as a result of the exit of compressed air through the uncovered micro openings 23. The air cushion that is generated by the exiting air ensures reduced friction, so that in automatic infeed processes, infeed aprons 41, which have a higher friction coefficient than the paper to be fed in, can be used effectively. When micro openings 23 are used for the turner bars 07, the leakage flow in the area that has not yet been covered by the triangular tip of the web 03, such as the infeed tip 39 or the infeed apron 41 is low. Therefore, the formation of an air cushion in the already covered area is effective.

While preferred embodiments of a device and a method for feeding a material web to a printing unit of a web-fed rotary printing press, in accordance with the present invention, have been set forth fully and completely hereinabove, it will be apparent to one of skill in the art that changes in, for example, the specific type of printing press, the source of supply of the compressed air and the like could be made without departing from the true spirit and scope of the present invention which is accordingly to be limited only by the appended claims.

What is claimed is:

1. A device for feeding a material web to a web-fed rotary printing press having a printing unit, said device comprising:

a reel stand which carries a reel of said material web, said reel stand being arranged laterally next to the rotary printing press, said material web having a web path travel direction from said reel stand to said printing unit which is transverse to a machine alignment of said web-fed rotary printing press;

at least one turner bar arranged in the web path travel direction between said reel stand and said printing unit, which at least one turner bar is inclined 45° in relation to the web path travel direction of the material web which is running up to said printing unit from said reel stand;

an outer surface on said turner bar, said outer surface including a wraparound angular region defined as an area of said outer surface of said turner bar which cooperates with said web as said web is turned by said turner bar from said web path travel direction to said machine alignment, said wraparound angular region of said outer surface having a length;

a plurality of outlet openings in said outer surface of said turner bar and embodied as micro openings which are adapted for the passage of a pressurized fluid, said outlet openings covering at least said wraparound angular region of said outer surface of said turner bar, a maximum average diameter of said micro openings being 500 μm, said plurality of outlet openings extending over said length of said wraparound angular region of said outer surface of said turner bar; and a hollow interior space in said turner bar and in fluid communication with said micro openings and through which said pressurized fluid flows, wherein, as the material web is moving, over said wraparound angular region of said turner bar, said hollow interior space is supplied with said pressurized fluid which exits through said micro openings over said length of said wraparound annular region which is greater than the width of said wraparound angular region of said outer surface of said turner bar which is covered by the material web which wraps around it when said material web is turned by said turner bar.

2. The device according to claim 1, characterized in that said printing unit has a rotating processing tool that cooperates with said material web, wherein the turner bar, which is arranged in the web path between said reel stand and said printing unit, is arranged at a level of the web-fed rotary printing press that is above a level of said rotating processing tool.

3. The device according to claim 1, characterized in that, at least on a part of the material web path between said reel stand and said printing unit, a motorized web transport device, that guides a leading edge of said material around said turner bar, is provided and is adapted to provide a non-manual, motorized infeed of said web leading edge.

4. The device according to claim 1, characterized in that as said material web is moving, said pressurized fluid also exits through ones of said micro openings that are not wrapped by said material web in at least one longitudinal section of said turner bar.

5. The device according to claim 1, characterized in that as said material web is moving, said turner bar is wrapped by said material web and by a leading edge of said material web, wherein in at least one longitudinal section of said turner bar, said pressurized fluid exits through ones of said micro openings that are not wrapped by said material web.

6. The device according to claim 1, characterized in that during production of said web-fed rotary printing press, said turner bar is wrapped by a material web that is narrower than said maximum web width that can be processed in said printing press, and wherein said pressurized fluid flows out of ones of said micro openings not covered by said material web which is narrower than said maximum web width.

7. The device according to claim 1, characterized in that during, the process for feeding said material web, said turner bar is provided with said pressurized fluid over its entire active length, and said pressurized fluid flows out of said micro openings over said entire active length of said turner bar.

8. The device according to claim 1, characterized in that said material web has a triangular web leading edge and wherein, when said turner bar is wrapped by said triangular web leading edge, said turner bar is provided with said pressurized fluid over its entire active length, and said pressurized fluid flows out of micro openings over said entire active length of said turner bar.

9. The device according to claim 1, characterized in that, said turner bar is arranged horizontally such that a longitudinal axis (L) of said turner bar extends within a horizontal plane.

10. The device according to claim 1, characterized in that said printing unit has a rotating processing tool that cooperates with said material web.

11. The device according to claim 10, characterized in that said printing unit and said reef stand are arranged offset in relation to one another, as viewed with respect to the direction of a rotational axis of said processing tool of said printing unit.

12. The device according to claim 10, characterized in that a rotational axis of said reel of material on said reel stand and said rotational axis of said processing tool extend perpendicular to one another.

13. The device according to claim 2, characterized in that said turner bar has said length of said wraparound angular region that is actively used for turning said material web, wherein a projection of said length on a width of said incoming material web corresponds to at least a maximum web width that is processed in the web-fed rotary printing press.

14. The device according to claim 6, characterized in that said maximum web width that is processed in said web-fed. rotary printing press corresponds to a width of four newspaper pages in a broadsheet format.

15. The device according to claim 6, characterized in that said maximum web width that is processed in said web-fed rotary printing press corresponds to a width of six newspaper pages in a broadsheet format.

16. The device according to claim 2, further including a plurality of said printing units, wherein at least two of said plurality of printing units are arranged side by side in said machine alignment, as viewed in a direction perpendicular to a rotational axis of each of said respective processing tools in each of said at least two of said plurality of said printing units.

17. The device according to claim 16, characterized in that a machine center plane of said machine alignment extends perpendicular to said rotational axes of said processing tools of said at least two printing units and also extends through a center section of a usable cylinder length of each of said processing tools.

18. The device according to claim 17, characterized in that a plurality of said reel stands are arranged laterally next to said machine alignment.

19. The device according to claim 18, further including a shared platform and characterized in that two adjacent ones of said plurality of reel stands, and each having a loading side, each point with each said loading side, toward said shared platform that is situated between said two adjacent reel stands.

20. The device according to claim 1, including two spaced ones of said printing units and wherein two horizontal turner bars are arranged in a space between said two spaced printing units.

21. The device according to claim 1, including two spaced ones of said printing units and wherein two horizontal turner bars are arranged above an intermediate spaced located between said two spaced printing units.

22. The device according to claim 1, characterized in that the maximum average diameter of said micro openings is 300 μm.

23. The device according to claim 1, characterized in that said micro openings are embodied as open pores in a porous material.

24. The device according to claim 1, characterized in that said turner bar is tubular and has said micro openings in said wraparound angular region which is less than 270° in circumference.

25. The device according to claim 1, characterized in that said turner bar, has said micro openings over at least said length of said wraparound angular region whose projection on a width of the incoming material web corresponds to a maximum web width that can be processed in said web-fed rotary printing press.

26. The device according to claim 25, characterized in that said turner bar, which is provided with said pressurized fluid over said length of said wraparound angular region that is equipped with said micro openings, is wrapped by said material web having a width which is narrower than that of said maximum web width that is processed in said web-fed rotary printing press.

27. The device according to claim 1, characterized in that a material web transport device is provided, and which is usable to guide a leading edge of said material web around said turner bar.

28. The device according to claim 27, characterized in that said transport device is embodied having a guide and further having an endless chain that is transported in said guide.

29. The device according to claim 27, characterized in that said transport device is embodied having an infeed belt and having tape pulleys, said infeed belt being guided over said tape pulleys.

30. The device according to claim 2, characterized in that said rotating processing tool is a printing couple cylinder.

31. The device according to claim 1, characterized in that said reel stand is embodied as a reel changer adapted for use in conducting for a flying reel change.

* * * * *

UNITED STATES PATENT AND TRADEMARK OFFICE

CERTIFICATE OF CORRECTION

PATENT NO. : 7,975,608 B2
APPLICATION NO. : 12/225300
DATED : July 12, 2011
INVENTOR(S) : Beck et al.

It is certified that error appears in the above-identified patent and that said Letters Patent is hereby corrected as shown below:

Column 13, claim 1, line 26, before “region”, change “annular” to --angular--; and Column 16, claim 31, line 19, after “conducting”, delete “for”.

Signed and Sealed this
First Day of November, 2011

David J. Kappos

David J. Kappos
*Director of the United States Patent and Trademark Office*